US009296247B2

(12) United States Patent
Christensen et al.

(10) Patent No.: US 9,296,247 B2
(45) Date of Patent: Mar. 29, 2016

(54) MULTIPLE POCKET FOLDERS AND METHOD OF MANUFACTURE

(71) Applicant: Smead Manufacturing Company, Hastings, MN (US)

(72) Inventors: Duane Christensen, Hastings, MN (US); David J. Gilbertson, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 28 days.

(21) Appl. No.: 14/195,740

(22) Filed: Mar. 3, 2014

(65) Prior Publication Data

US 2014/0252074 A1 Sep. 11, 2014

Related U.S. Application Data

(60) Provisional application No. 61/773,387, filed on Mar. 6, 2013.

(51) Int. Cl.
*B42F 7/06* (2006.01)
*B42C 7/00* (2006.01)

(52) U.S. Cl.
CPC .. *B42F 7/06* (2013.01); *B42C 7/002* (2013.01)

(58) Field of Classification Search
CPC ..... B65D 27/08; B42F 21/02; B42F 21/00; B42F 7/02; B42C 7/002
USPC ..... 229/67.1–67.4
See application file for complete search history.

(56) References Cited

U.S. PATENT DOCUMENTS

| | | | | | |
|---|---|---|---|---|---|
| 284,272 | A * | 9/1883 | Brown | 229/67.1 |
| 2,318,278 | A * | 5/1943 | Arnold | 229/72 |
| 2,503,592 | A * | 4/1950 | Pate | 229/67.1 |
| 3,528,602 | A * | 9/1970 | Ritchie | 229/67.1 |
| 3,858,790 | A * | 1/1975 | Humphrey | 229/72 |
| 3,870,223 | A * | 3/1975 | Wyant | 229/72 |
| 4,109,850 | A * | 8/1978 | Meenan et al. | 229/72 |
| 4,758,022 | A * | 7/1988 | Podosek et al. | 281/15.1 |
| 4,934,584 | A * | 6/1990 | Wyant | 229/67.1 |
| 4,989,777 | A * | 2/1991 | Miller | 229/67.1 |
| 5,025,978 | A * | 6/1991 | Pacione | 229/67.1 |
| 5,598,969 | A * | 2/1997 | Ong | 229/67.1 |
| 6,409,409 | B2 * | 6/2002 | Bauman et al. | 402/79 |
| 6,679,418 | B1 * | 1/2004 | Schwartz | 229/67.4 |
| 7,306,134 | B1 * | 12/2007 | Ong | 229/67.1 |
| 8,550,329 | B2 * | 10/2013 | Busam et al. | 229/67.1 |
| 2006/0016862 | A1 * | 1/2006 | Makofsky | 229/67.3 |
| 2006/0060641 | A1 * | 3/2006 | Taylor | 229/67.1 |
| 2007/0228118 | A1 * | 10/2007 | Makofsky | 229/67.1 |
| 2008/0257940 | A1 * | 10/2008 | Busam et al. | 229/67.1 |
| 2009/0114704 | A1 * | 5/2009 | Howlett | 229/67.1 |
| 2009/0205231 | A1 * | 8/2009 | Fasbender | 40/359 |
| 2011/0073638 | A1 * | 3/2011 | Grassia et al. | 229/67.1 |
| 2011/0084119 | A1 * | 4/2011 | Zapalac | 229/67.1 |
| 2011/0210159 | A1 * | 9/2011 | Grassia et al. | 229/67.1 |

* cited by examiner

*Primary Examiner* — J. Gregory Pickett
*Assistant Examiner* — Peter Helvey
(74) *Attorney, Agent, or Firm* — Altera Law Group, LLC

(57) ABSTRACT

Pocket folders for holding documents and method of manufacture are shown in various embodiments. In one embodiment, a single unitary blank is cut and folded into a double slot folder without the need to glue pieces together. The blank is cut to have adjacent panels and an extension panel cut so that they are folded one panel atop the other to form a unitary pocket folder with two pockets. In a second embodiment, a two pocket folder is formed likewise with three adjacent panels as in the first embodiment, but the extension panel is then wrapped with a back panel to create a second pocket which can be folded outwardly.

11 Claims, 18 Drawing Sheets

MULTIPLE POCKET FOLDERS AND METHOD OF MANUFACTURE

BACKGROUND

1. Field of the Disclosure

The present invention is directed to folders for use in connection with storage of documents.

2. Description of the Related Art

Folders and more particularly pocket folders are useful for holding documents permanently or temporarily. For competitive reasons they must be made inexpensively, but without sacrificing durability and functionality. Most folders are designed with a single pocket because that is the most inexpensive form to make, but there has been a long felt need for multi-pocket folders but which can still provide durability and low cost. The present disclosure provides such a solution.

BRIEF SUMMARY

To assist the reader in preparing to digest the detailed description and claims below, a short summary has been provided. It is far from complete and only provides a glimpse of the invention concepts. It is not intended to define the scope of the invention. The claims perform that function.

The present disclosure shows a multi-pocket disclosure in several embodiments.

In one embodiment, the folder includes a back panel with first and second sides having bottom edges and separated by a central fold line, the first side including a foldable extension which extends beyond the bottom edge, said extension forming the front panel of a foldable pocket and a further back panel having lateral flaps, said back panel being located behind said front panel and said flaps wrapped around and affixed to the front side of said front panel, thereby forming a pocket, said pocket being foldable at said bottom edge; so that the folder has two pockets one of which is formed in conjunction with the other.

In another embodiment, the folder includes a back panel with first and second sides having bottom edges and separated by a central fold line, the first side including a foldable extension which extends beyond the bottom edge, said extension forming the front panel of a foldable pocket and a pocket formed from further panel having a front portion, a back portion said portions being folded together along a longitudinal fold line thereby forming a pocket bottom, a pair of lateral flaps extending from one of the portions and folded around the other portion to form sidewall of the pocket. Said pocket being affixed to said extension so that said pocket can be folded outwardly at said bottom edge thereby opening a pocket formed between the pocket and the first side.

In a further embodiment, there is disclosed a double pocket folder formed of unitary a blank having a first and second panels, each having side and top and bottom edges, said bottom edges straddling a central fold line therebetween; said first panel forming a back of the folder and a portion thereof at the top edge being a top tab section. An extension panel extending laterally from a side edge of the first panel foldable along a second fold line generally orthogonal to the central fold line; said extension panel being of such width, that when folded over said first panel it does not occlude said top tab section thereof, said extension panel further including at least a bottom flap extending from a bottom edge thereof; whereby said folder is formed by folding said second panel over said first paid along said central line, to create a first pocket therebetween and then folding said extension panel over said second panel and affixing said flap to the back of said first panel, thereby creating a second pocket therebetween and a bottom for both pockets.

In a further embodiment, the extension panel has a further foldable side flap on its edge adjacent and generally orthogonal to said bottom flap, to be applied to the back of said first panel to create side boundary of the pockets.

In a further embodiment, the blank is one continuous web of material, all panels and flaps being part of a single unitary web.

In a further embodiment, said second panel includes a notch adjacent said central fold line at the intersection of the first, second and extension panels.

In a further embodiment, the height from top to bottom of said second panel is less than the first panel and the height of the extension panel is less than that of said second panel so that when said panels are folded, the panels stepwise; increase in height from front to back.

In an alternate embodiment said second panel has a top edge which is cut at a diagonal and wherein said extension flap likewise has a top edge cut at a diagonal, and wherein the diagonal cut on the extension panel is deeper than the cut on said second panel, so that when said panels are folded, the panels stepwise; increase in height from front to back.

DETAILED DESCRIPTION

This disclosure describes file folders, sometimes known as pocket folders, in various related embodiments.

The following is an overview: FIGS. 1-9 disclose a double pocket folder whereas FIGS. 10-19 illustrate a variant diagonal cut to expose more of the documents stored therein. FIGS. 20-27 illustrate a double pocket folder with a fold out pocket. Several variants thereof are disclosed. To the extent that parts are the same or similar, the same reference number will be used or an increment thereof, such as 10 and 110.

A method of manufacture is also disclosed by the drawings and description.

Figure 1:
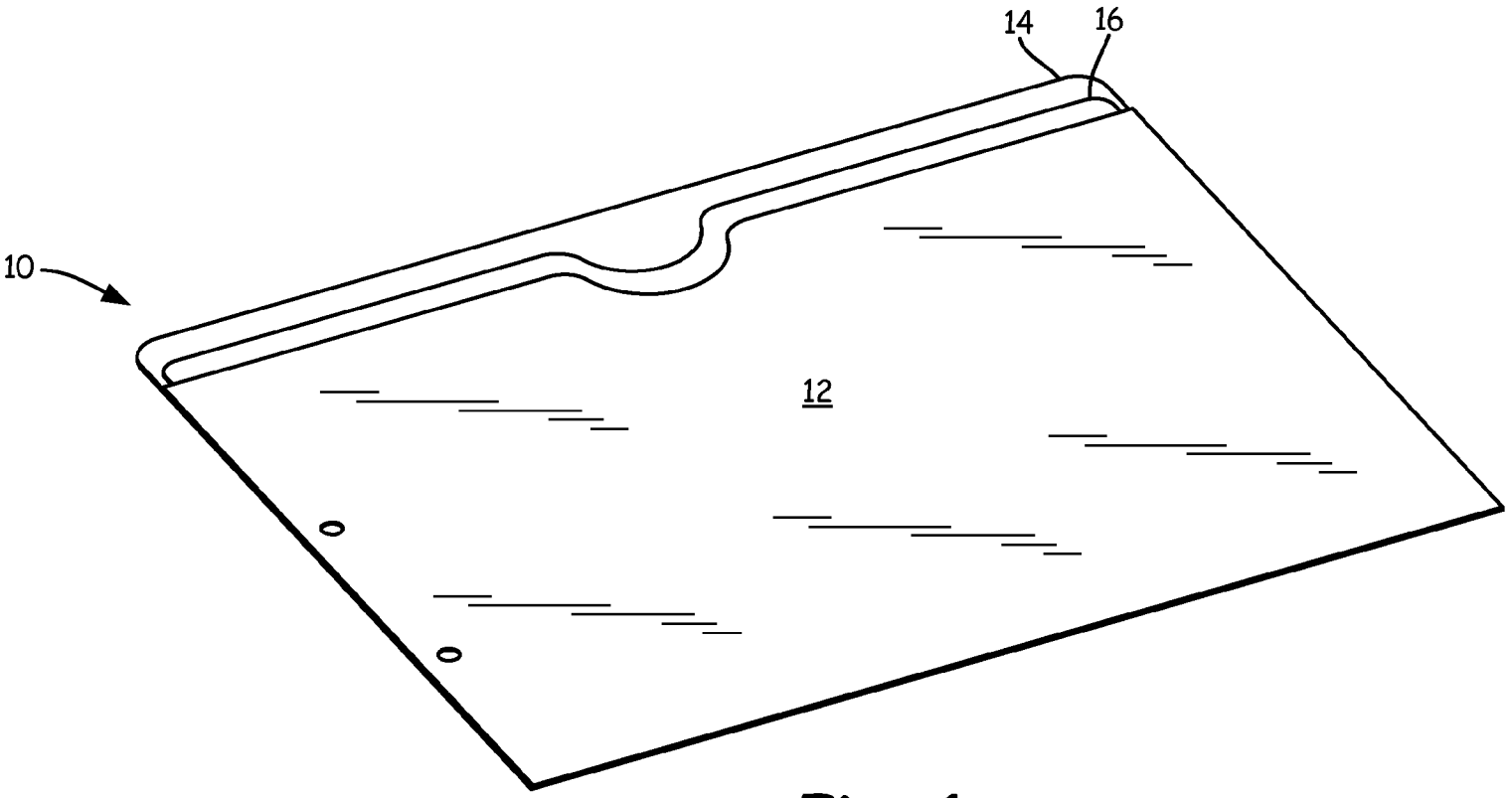
FIG. 1 is a perspective view of a first embodiment of a double pocket file folder.
Figures 2, 4, 5, 6, 7:
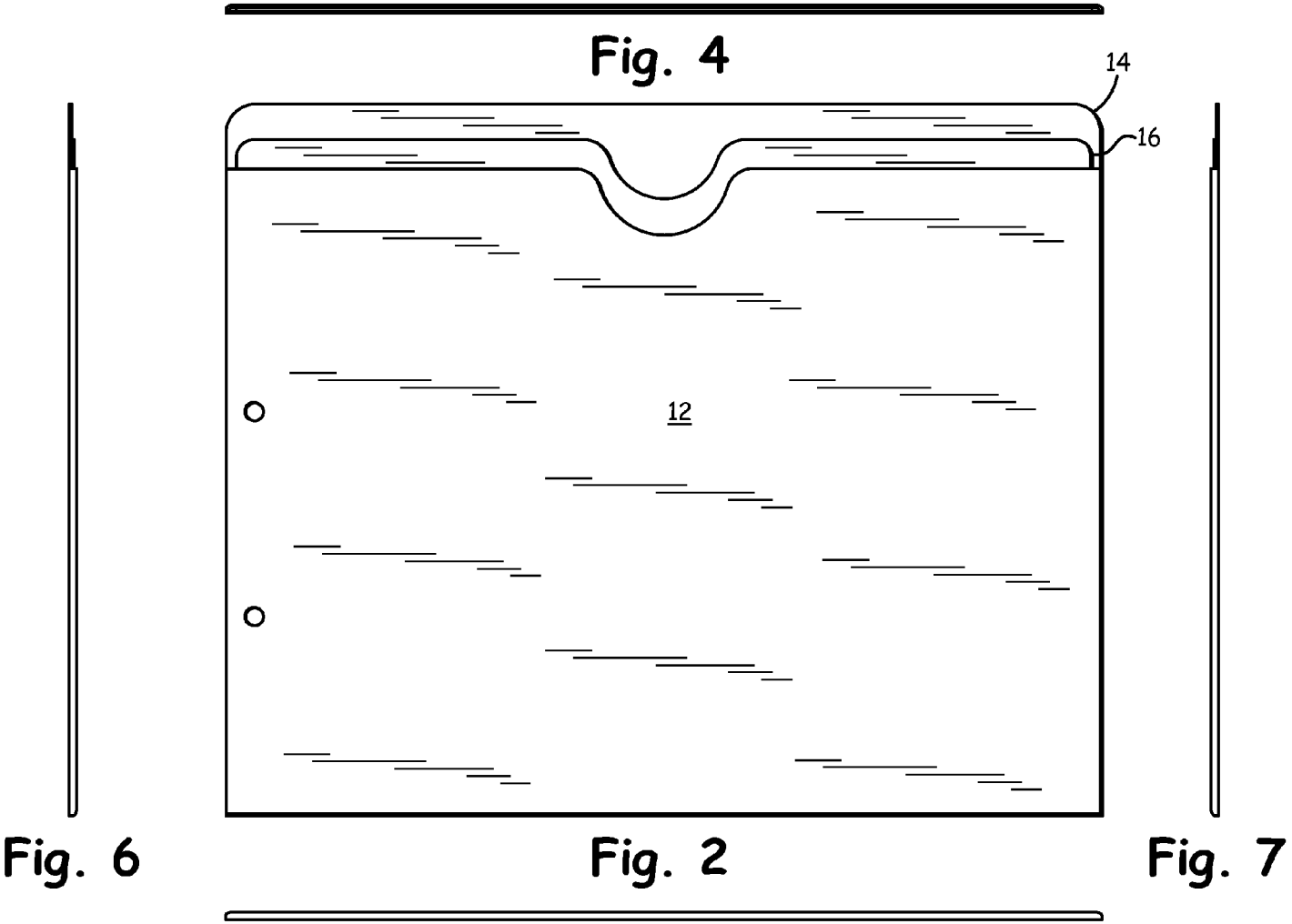
FIG. 2 is front plan view of the embodiment in FIG. 1.
FIG. 4 is a top view of the embodiment in FIG. 1.
FIG. 5 is a bottom view of the embodiment in FIG. 1.
FIG. 6 is a side view of the embodiment in FIG. 1.
FIG. 7 is the other side view of the embodiment in FIG. 1.
Figure 3:
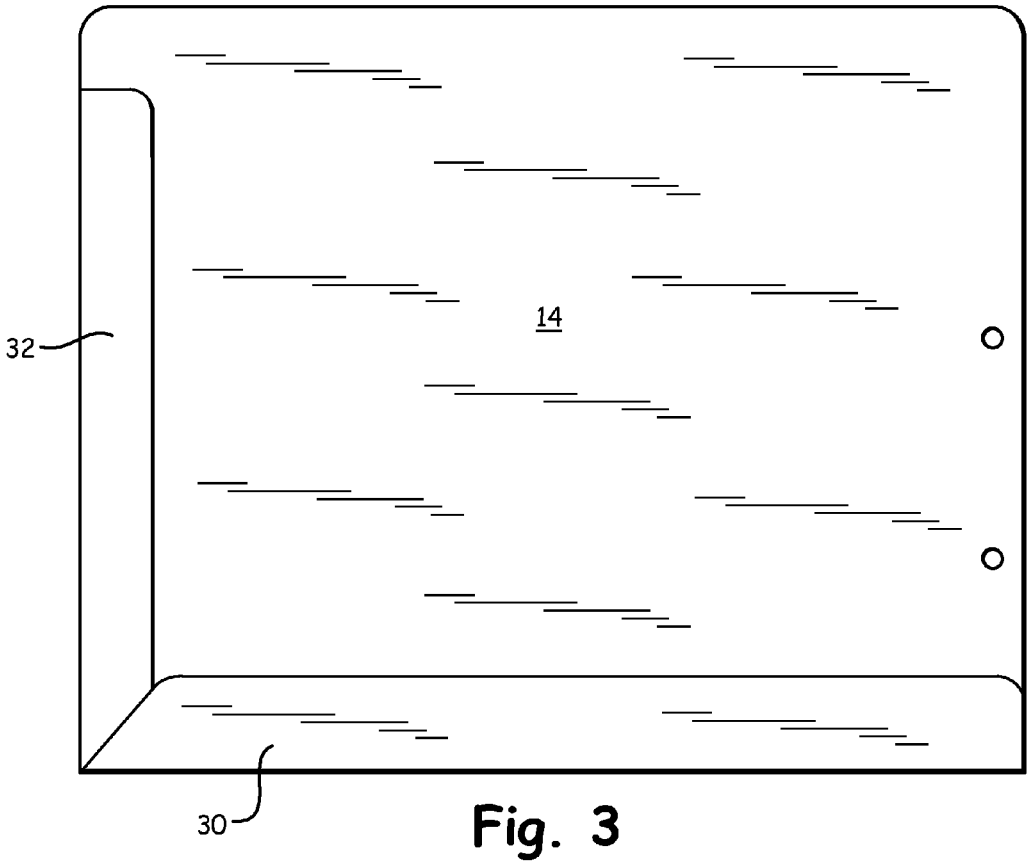
FIG. 3 is rear plan view of the embodiment in FIG. 1.
Figure 8:
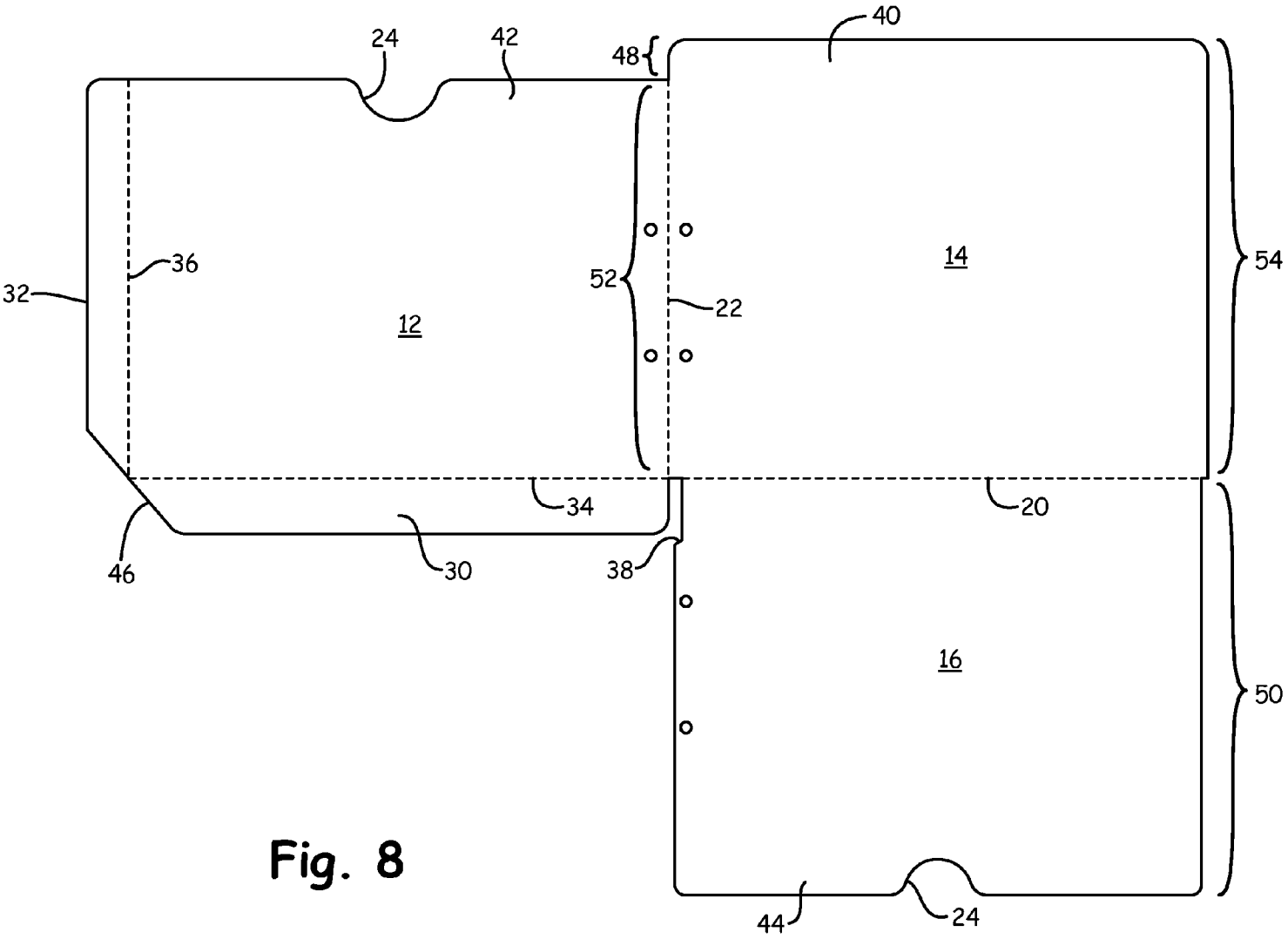
FIG. 8 is top plan view of a blank cut according to the embodiment.
Figure 9:
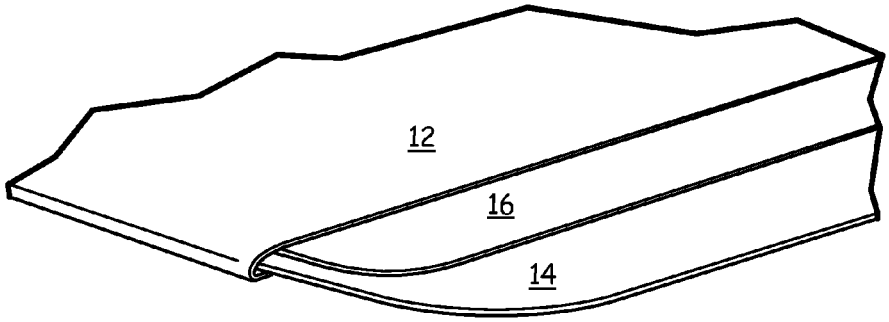
FIG. 9 is a close up fragmentary view of a portion of the embodiment in FIG. 1.
Figure 10:
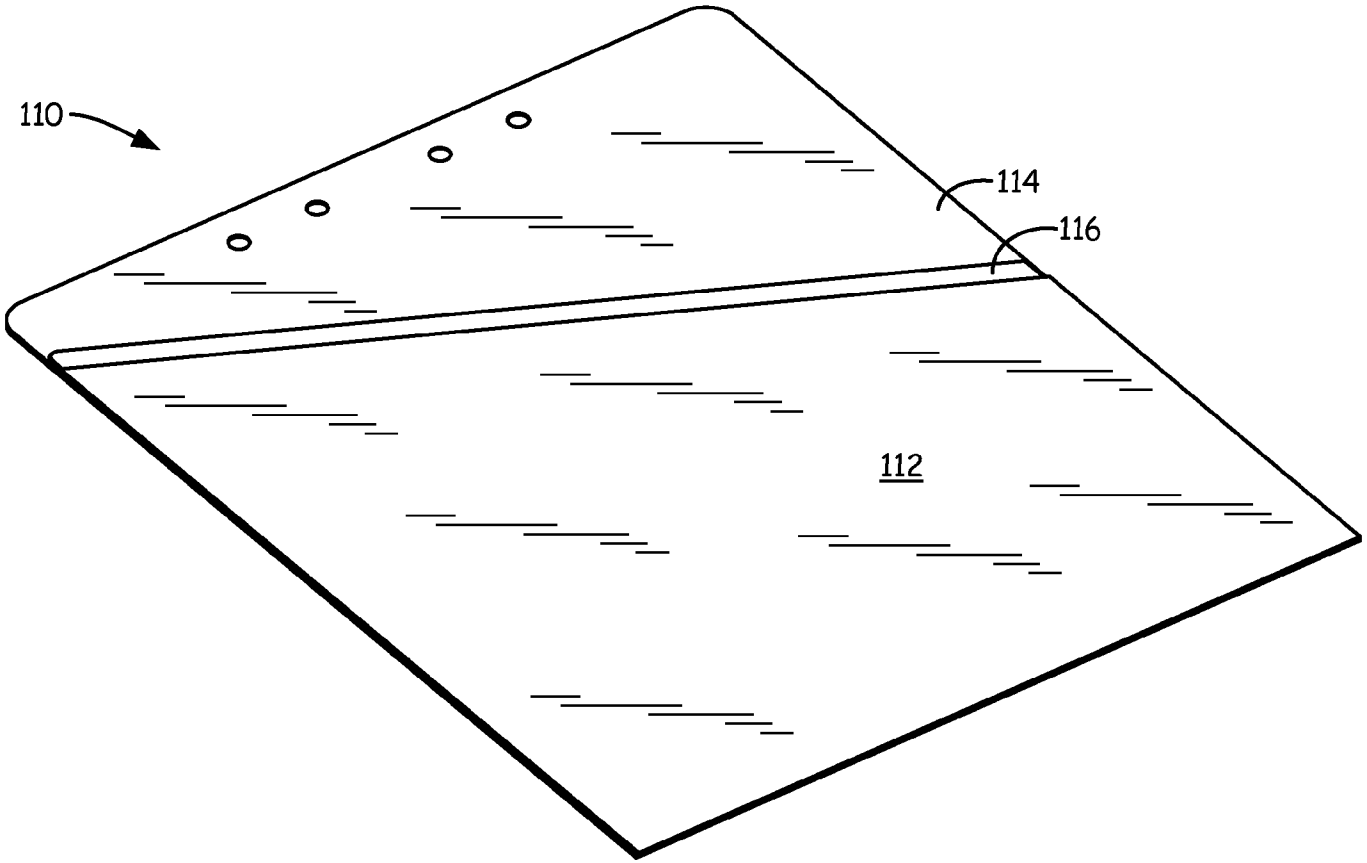
FIG. 10 is a perspective view of a second embodiment of a double pocket file folder.
Figures 11, 13, 14, 15, 16:
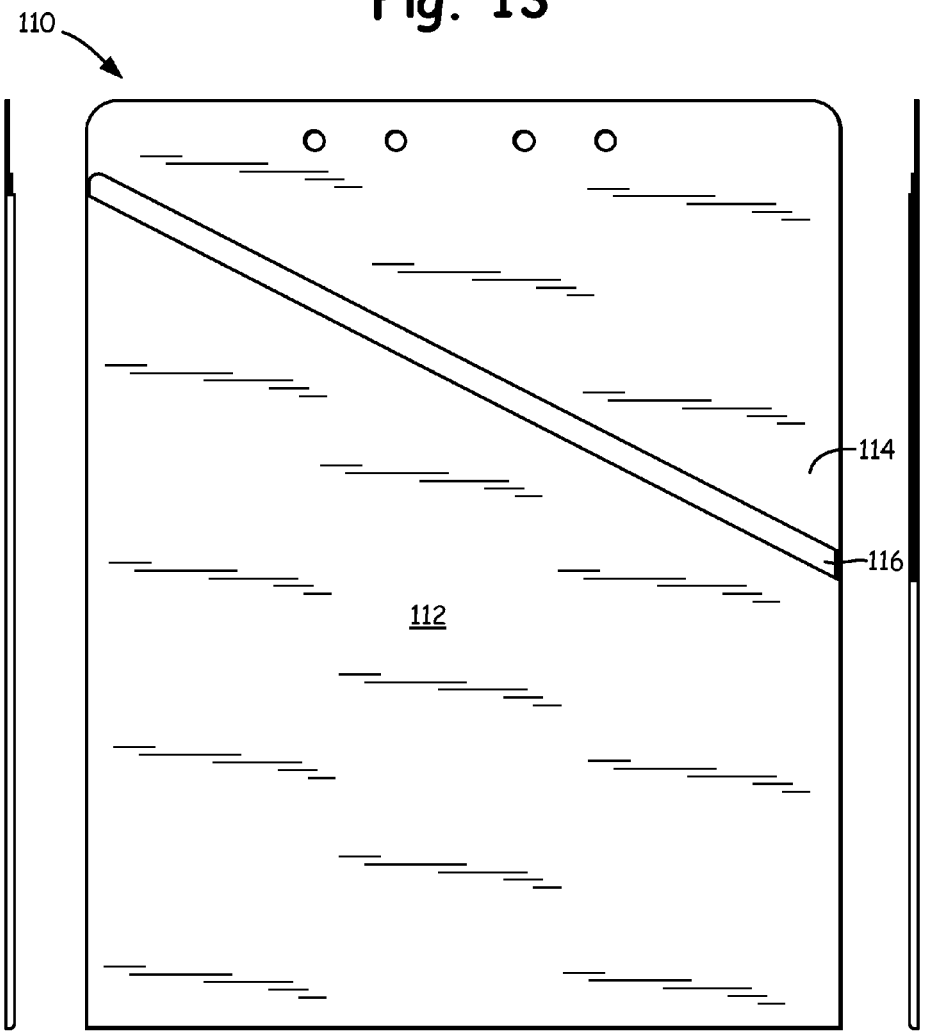
FIG. 11 is a front plan view of the embodiment in FIG. 10.
FIG. 13 is a top view of the embodiment in FIG. 10.
FIG. 14 is a bottom view of the embodiment in FIG. 10.
FIG. 15 is a side view of the embodiment in FIG. 10.
FIG. 16 is the other side view of the embodiment in FIG. 10.
Figure 12:
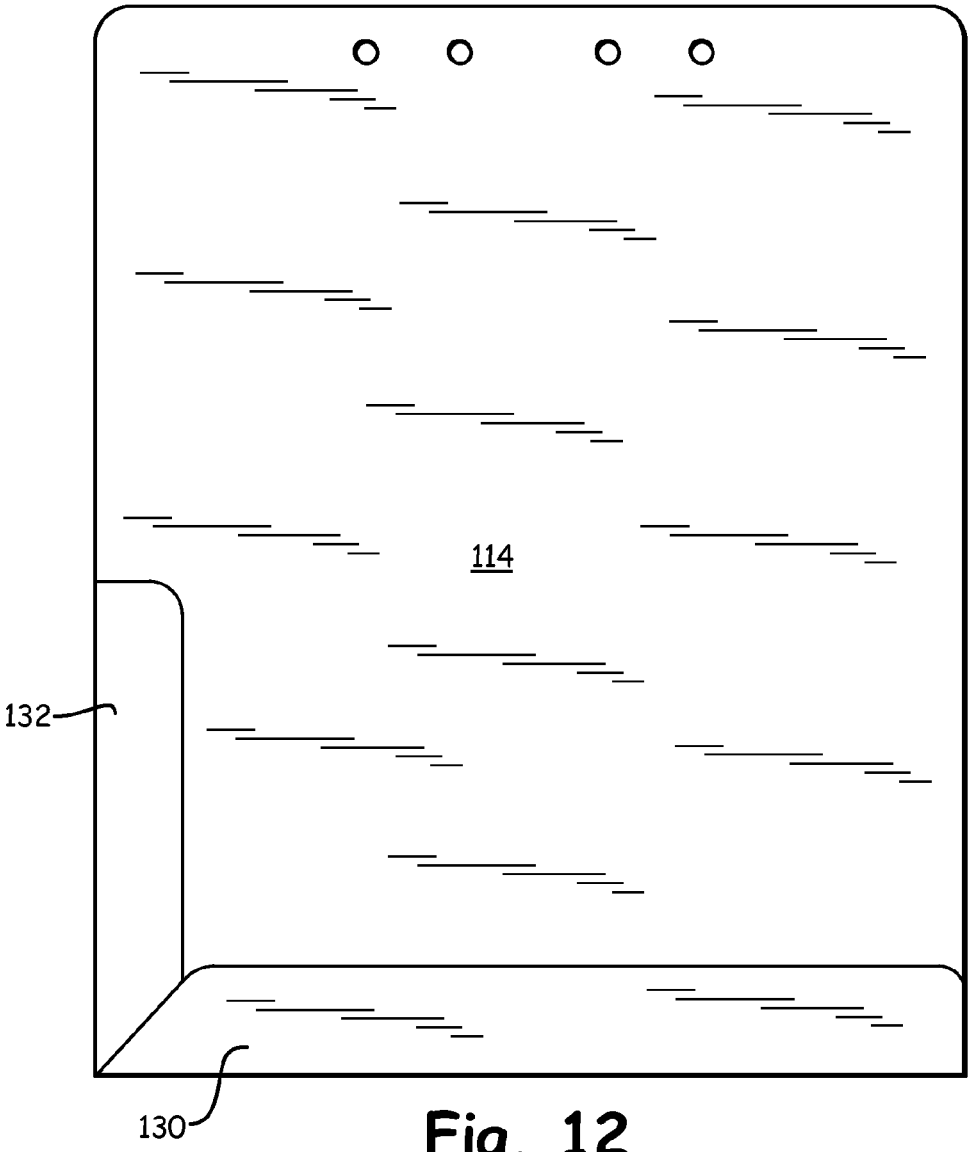
FIG. 12 is a rear plan view of the embodiment in FIG. 10.
Figure 17:
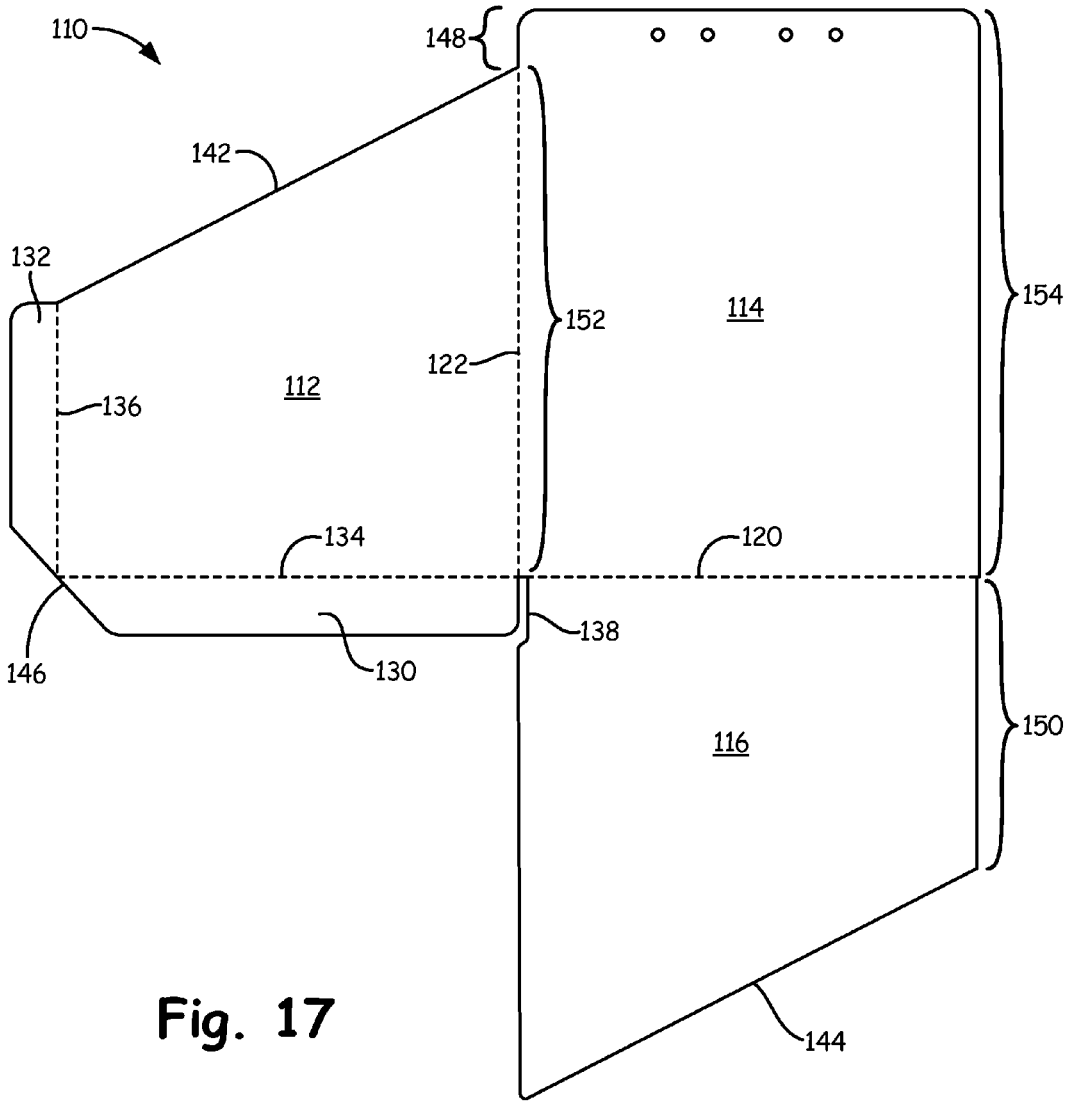
FIG. 17 is a top plan view of a blank cut according to the embodiment in FIG. 10.
Figure 18:
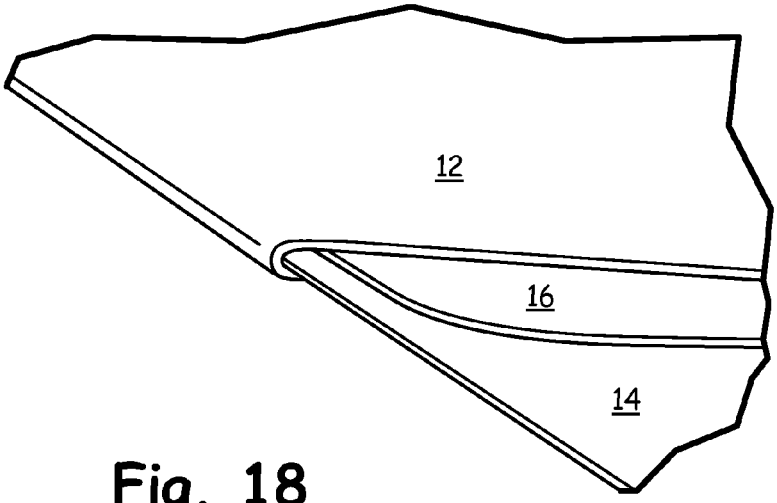
FIG. 18 is a close up fragmentary view of a portion of the embodiment in FIG. 10.
Figure 19:
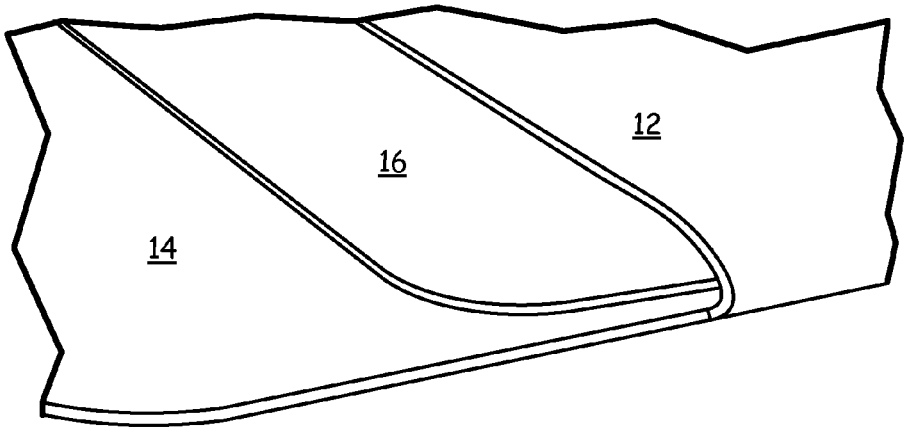
FIG. 19 is a close up fragmentary view of a portion of the embodiment in FIG. 10 from a different angle than FIG. 18.

File folder 10 in FIGS. 1-9 show a unitary blank with a front extension panel 12, back/first panel 14 and second panel 14. The extension panel 12 extending laterally from the back panel 14 along a fold line 20. Extension panel 12 extends from panel 14 along fold line 22, thumb notches 24 may be provided. Panel 12 which becomes the front panel when folded, includes a pair of flaps 30, 32 which complete the folder when the flaps are adhered to the back panel as shown in FIG. 3. Flap 30 is an extension of the front panel along the longitudinal edge and 32 is an extension along the lateral edge along fold lines 34, 26. Notch 38 in panel 16 adjacent the fold line 20 is cut into the lateral edge of the panel to provide expansion space for the pocket which is formed. It is extended from fold line 20 upwardly toward the distal edge. The notch is typically of 2-5 cm in length and 2-3 mm deep or roughly just exceeding the height of flap 30 and prevents puckering and binding.

In order to insure that there will be tab/writing space 40, 42, 44 visible at the top (distal) edge of each panel, it is preferably to offset/cut away a portion of panel 12 at its top tab edge 42. This offset 48 provides exposure of the tab section 40 of panel 16 by being shorter than height 54 in panel 14. Likewise panel 16 must have its lateral height 50 shorter than both heights 52 and 54 in order that all tabs areas are exposed. The corner 46 of panel 12 is cut an angle to reduce interference between the tabs 30, 32.

The method of manufacturer is to cut a single unitary blank. Unitary means that the material is a continuous web, not joined from separate pieces. The preferred cut pattern is as follows: a back panel with first and second sides having bottom edges and separated by a central fold line, the first side including a foldable extension panel which extends beyond the bottom edge, the extension forms the front panel of a foldable pocket and has lateral flaps, when formed to make a folder. The second panel 16 is folded upwarded along fold line 20 and then the extension panel 12 is folded onto the second panel 16 and flaps 32/30 (or just 30 if an open side is desire) are affixed to the back panel 14 thereby forming two pockets with a single unitary blank.

The embodiment shown in FIGS. 10-19 is similar to the previous embodiment and the parts are indicated with numerals incremented 100 and will not be repeated for brevity.

The folder 110 from which the blank differs in that the top edges 142, 144 are cut at an angle to expose more of the surface of the documents which may be stored in the pocket. This diagonal or slash cut can be as shown rising from left to right or right to left. Otherwise, the unitary nature of the blank and method of manufacture is the same as the prior embodiment.

FIGS. 20-27 illustrate an alternative construction and method of making a multiple pocket file folder. In this embodiment, a folder 210 has a front panel 212 and back panel 212, separated by a fold line 222.

Figure 20:
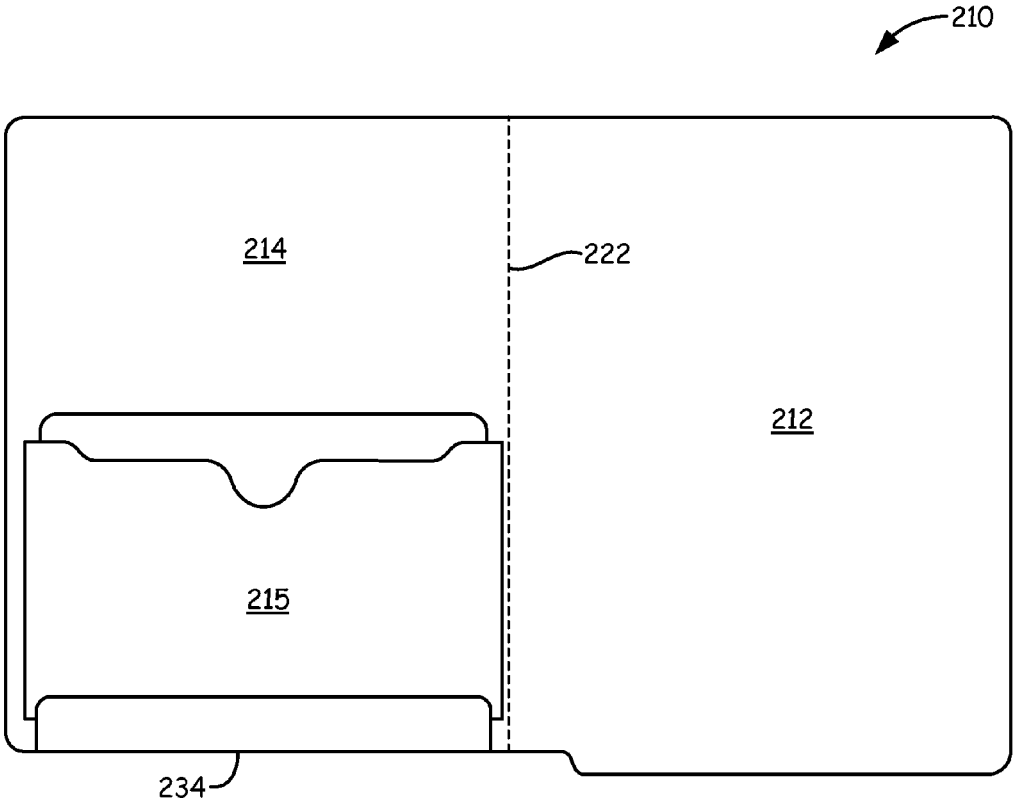
FIG. 20 is a top plan view of a third embodiment folder.
Figure 22:
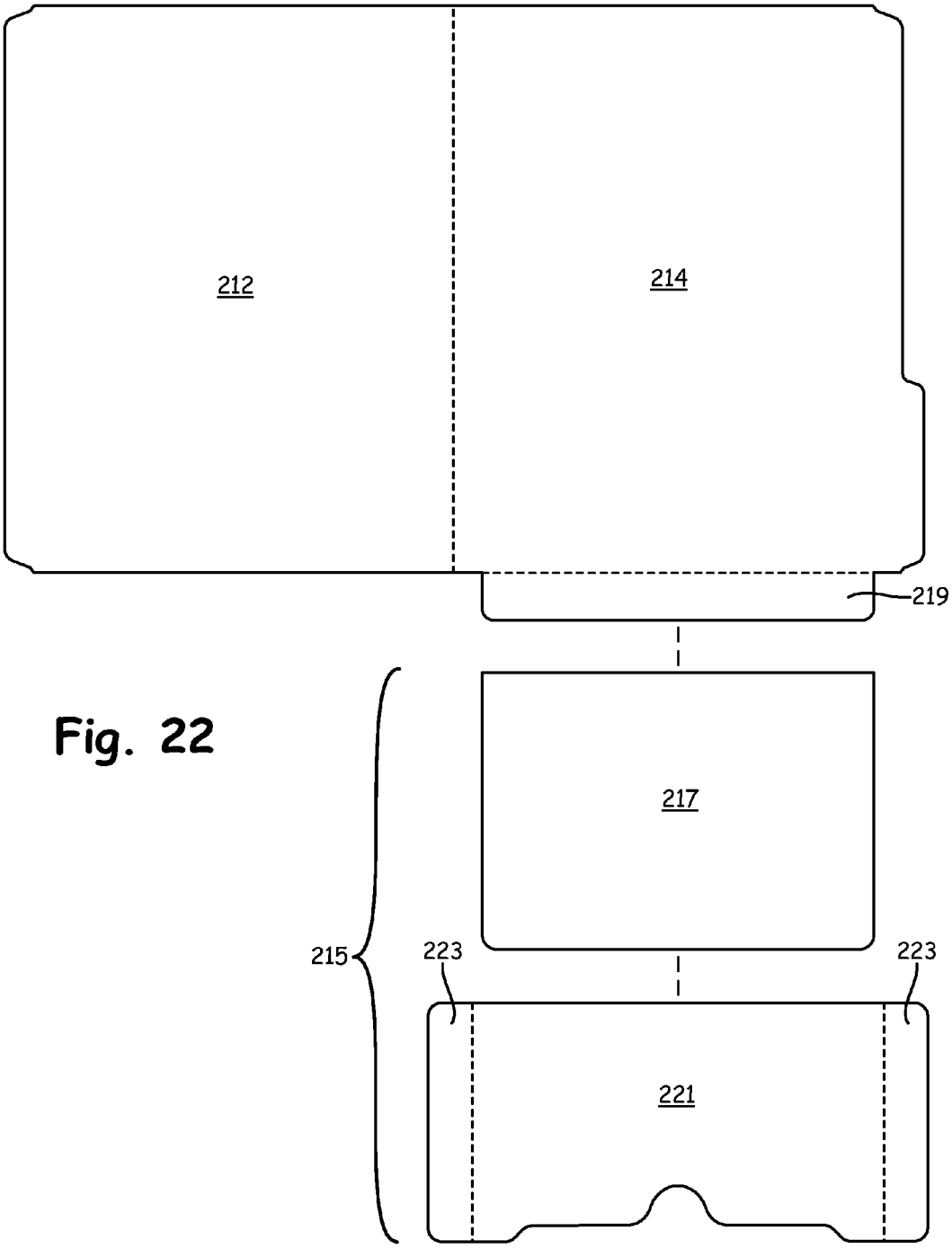
FIG. 22 is a bottom plan view, exploded of the embodiment in FIG. 20.

A pocket unit is attached to the bottom edge 234 by in various forms as shown in the figures. In FIGS. 20 and 22, the pocket unit 215 is a separate non unitary pocket having a back panel 217 which is affixed to panel 214 by tab extension 219 which extends from the bottom portion of panel 214. Note that tab 291 is preferably narrower than the width of panel 214.

To create a pocket, front panel 221 with tabs 223 is applied to the front of panel 217 and tabs 223 are affixed to the back of panel 217, though the reverse configuration with tabs in front is also possible.

Figure 21:
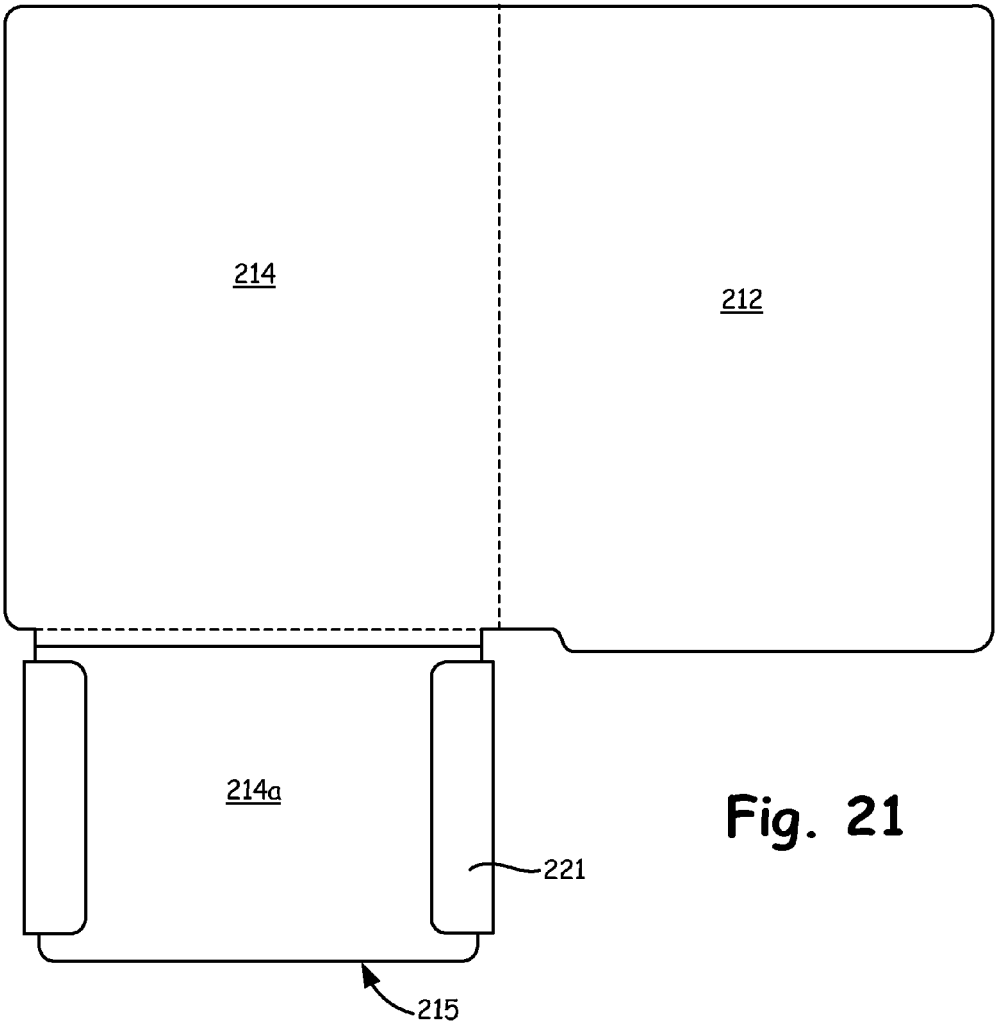
FIG. 21 is a top plan view of the folder in FIG. 20 with a portion folded out.

FIG. 21 is a similar embodiment except that the back panel 214 has a unitary extension 214*a* which forms a panel of pocket 215.

Figure 23:
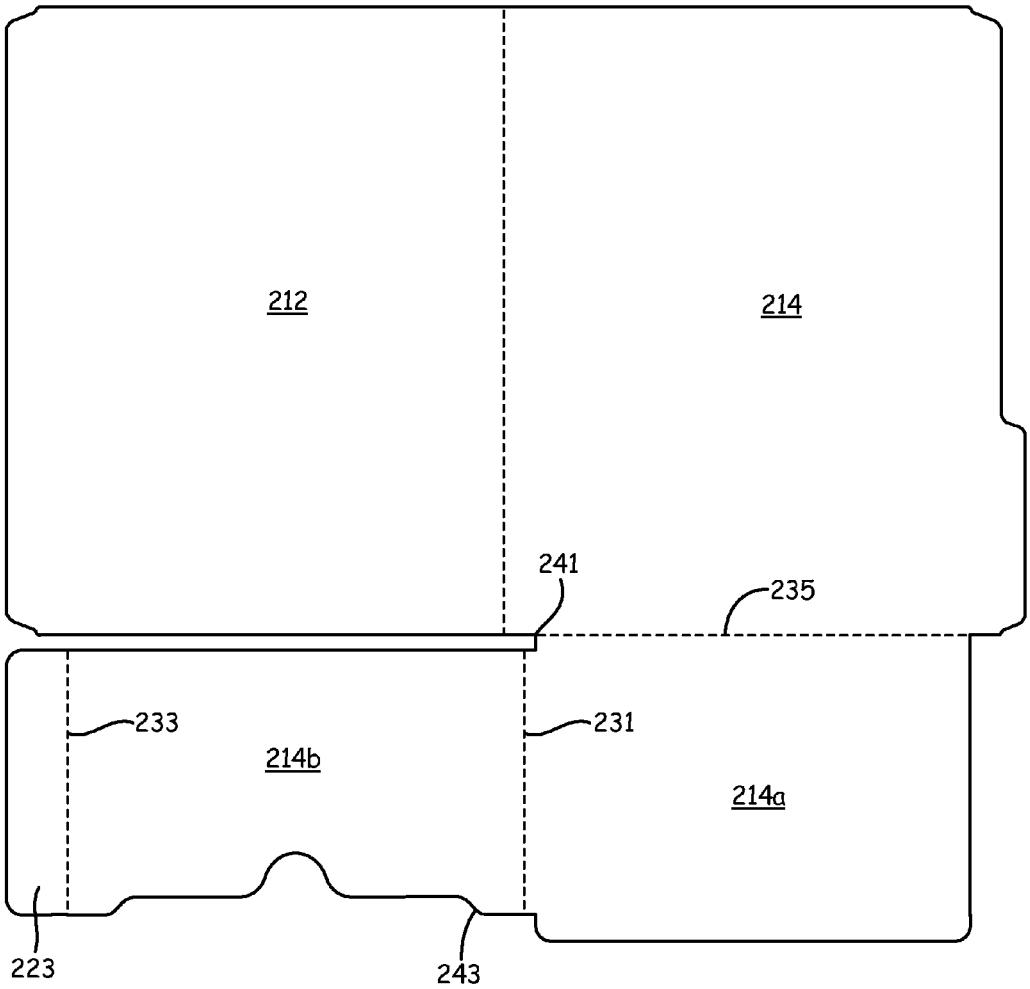
FIG. 23 is a bottom plan view of a fourth embodiment folder variant of FIG. 20.

FIG. 23 illustrates a completely unitary embodiment made from a single blank/web of material. Panel 214 has a first extension 214*a* extending longitudinally from the bottom thereof and lateral thereto a second extension 214*b* with tab 223. The pocket is formed by folding panel 214*b* onto 214*a* along fold line 231, then tab 223 is folded and affixed to 214*a* along fold line 233 and finally to formed pocket may be folded up along line 235.

Note that there is preferably a notch 241 laterally into panel 214*a* adjacent fold line 235, to provide expansion space within the pocket. Likewise, panel 214*b* can be folded in front of panel 214*a* or behind it. If in front, then its height will be lower than that of 214*a* by the cut down area 243 to allow visibility of documents therein.

Figure 24:
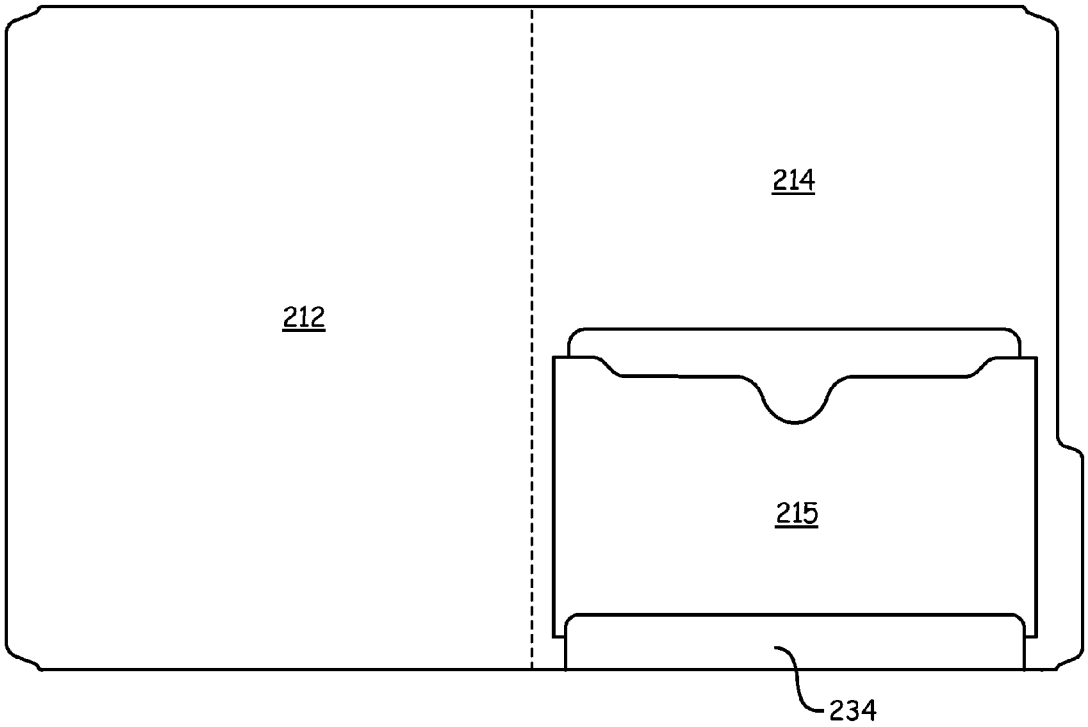
FIG. 24 is a top plan view of the embodiment in FIG. 20 with a different tab configuration.
Figure 25:
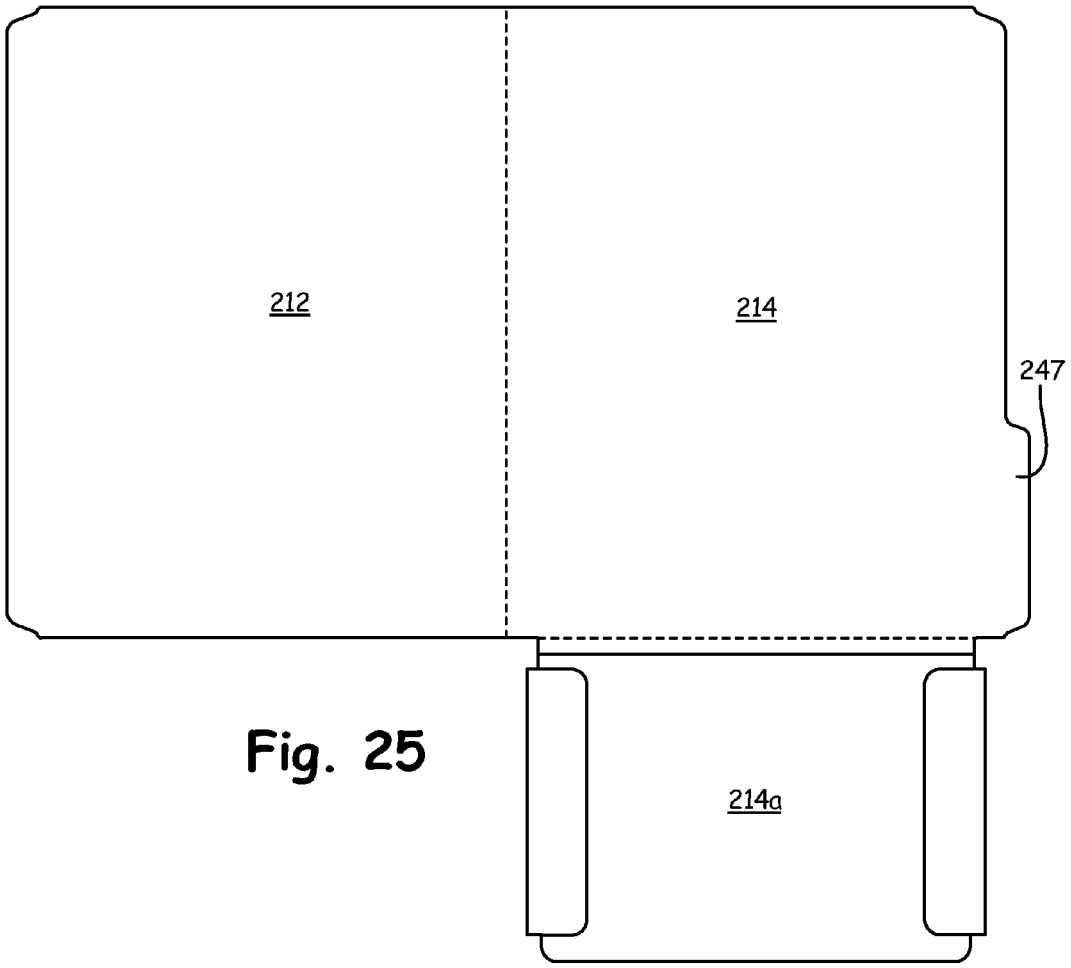
FIG. 25 is bottom plan view of fifth embodiment folder variant of FIG. 20.
Figure 26:
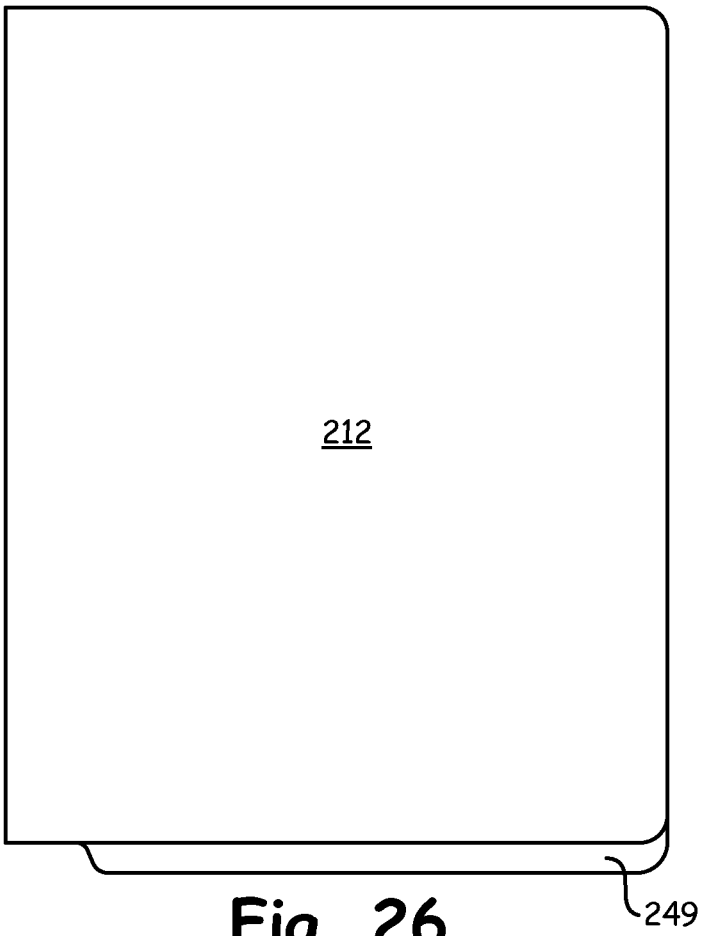
FIG. 26 is a rear view of the embodiment if FIG. 21.
Figure 27:
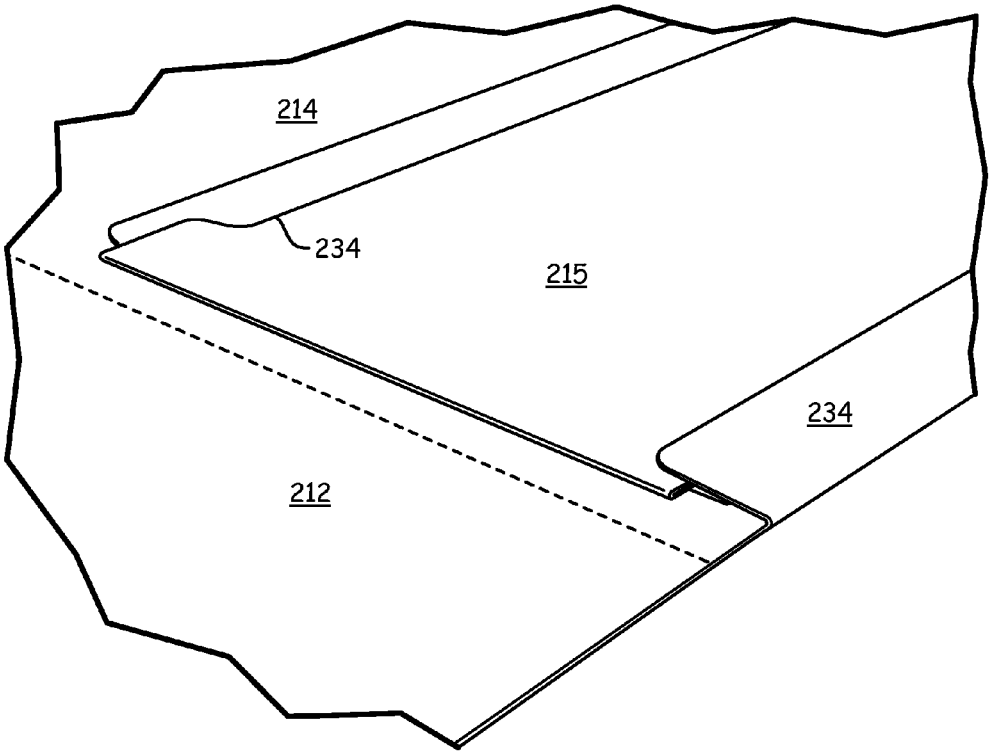
FIG. 27 in an inside perspective view of the embodiment in FIG. 21 and variants.

FIG. 24 shows the folder with the pocket folded up. FIG. 25 is like FIG. 21 but in a mirror image configuration and with a top tab 247. FIG. 26 is a view from the back on an end tab 249 version. FIG. 27 is a perspective view of the pocket.

The above description and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

The invention claimed is:

1. A multi-pocket folder comprising a two pocket folder each having a tab writing space associated with each pocket, said folder formed of unitary a blank having a first and second panels, each having side and top and bottom edges and a tab writing space adjacent said top edges, said bottom edges straddling a central fold line therebetween; said first panel forming a back of the folder and a portion thereof at the top edge being a tab writing space; said second panel being folded onto said first panel and configured such that the second panel does not occlude the tab writing space of the first panel: an extension panel having distal and proximal edges with said proximal edge extending laterally from a side edge of the first panel having a top tab section and being foldable along a second fold line generally orthogonal to the central fold line; said extension panel being of such width, that when folded over said first panel it does not occlude said tab writing space of said second panel, said extension panel further including at least a bottom flap extending from a bottom edge thereof and a side flap extending from the distal edge thereof;

whereby said folder is formed by folding said second panel over said first paid along said central line, to create a first pocket therebetween and then folding said extension panel over said second panel and affixing said bottom and said distal flaps to the first panel, thereby creating a second pocket therebetween and a bottom for both pockets having enclosed wall on three sides thereof, and wherein said second panel includes a notch extending from an intersection of said central fold line and said second fold line and extending toward the top edge of said second panel.

2. The folder according to claim 1, wherein the extension panel has a further foldable side flap on its edge adjacent and generally orthogonal to said bottom flap, to be applied to the back of said first panel to create side boundary of the pockets.

3. The folder according to claim 1, wherein the blank is one continuous web of material all panels and flaps being part of a single unitary web.

4. The folder of claim 1, wherein said bottom flap of said extension panel has a predetermined height and wherein said notch includes a recess extending away from said central fold line at least exceeding the predetermined height of said bottom flap.

5. The folder of claim 1, wherein the said second panel has a height from top to bottom edges, and wherein said first panel has a height from top to bottom edges, and wherein said second panel height is just less than said first panel height so that said tab writable surface is visible on said first panel, of said second panel is less than the first panel and the height of the extension panel is less than that of said second panel so that so that when said panels are folded, the panels stepwise; increase in height from front to back.

6. The folder of claim 1, wherein said second panel has a top edge which is cut at a diagonal and wherein said extension flap likewise has a top edge cut at a diagonal, and wherein the diagonal cut on the extension panel is deeper than the cut on said second panel, so that when said panels are folded, the panels stepwise increase in height from front to back.

7. The folder of claim 6, wherein said diagonal top edge has an upper proximal end adjacent the fold line and a lower distal end adjacent said flap.

8. The folder of claim 6, wherein said diagonal top edge has a lower proximal end adjacent the fold line and an upper distal end adjacent said flap.

9. The folder of claim 6, wherein said diagonal top edge has an upper proximal end adjacent the fold line and a lower distal end adjacent said flap on the extension and said diagonal top edge has a lower proximal end adjacent the fold line and an upper distal end adjacent said flap on the second panel so that the diagonals intersect.

10. A multi-pocket folder comprising a two pocket folder each having a tab writing space associated with each pocket, said folder formed of unitary a blank having a first and second panels, each having side and top and bottom edges and a tab writing space adjacent said top edges, said bottom edges straddling a central fold line therebetween; said first panel forming a back of the folder and a portion thereof at the top edge being a tab writing space; said second panel being folded onto said first panel and configured such that the second panel does not occlude the tab writing space of the first panel; an extension panel having distal and proximal edges with said proximal edge extending laterally from a side edge of the first panel having a top tab section and being foldable along a second fold line generally orthogonal to the central fold line; said extension panel being of such width, that when folded over said first panel it does not occlude said tab writing space of said second panel, said extension panel further including at least a bottom flap extending from a bottom edge thereof and a side flap extending from the distal edge thereof, said side flap configured to be affixed to a back side of the first panel;

whereby said folder is formed by folding said second panel over said first paid along said central line, to create a first pocket therebetween and then folding said extension panel over said second panel and affixing said bottom and said distal flaps to the first panel, thereby creating a second pocket therebetween and a bottom for both pockets having enclosed wall on three sides thereof.

11. A multi-pocket folder comprising a two pocket folder each having a tab writing space associated with each pocket, said folder formed of unitary a blank having a first and second panels, each having side and top and bottom edges and a tab writing space adjacent said top edges, said bottom edges straddling a central fold line therebetween; said first panel forming a back of the folder and a portion thereof at the top edge being a tab writing space; said second panel being folded onto said first panel and configured such that the second panel does not occlude the tab writing space of the first panel; an extension panel having distal and proximal edges with said proximal edge extending laterally from a side edge of the first panel having a top tab section and being foldable along a second fold line generally orthogonal to the central fold line; said extension panel being of such width, that when folded over said first panel it does not occlude said tab writing space of said second panel, said extension panel further including at least a bottom flap extending from a bottom edge thereof and a side flap extending from the distal edge thereof, said side flap configured to be affixed to a back side of the first panel;

whereby said folder is formed by folding said second panel over said first paid along said central line, to create a first pocket therebetween and then folding said extension panel over said second panel and affixing said bottom and said distal flaps to the first panel, thereby creating a second pocket therebetween and a bottom for both pockets having enclosed wall on three sides thereof; and wherein said second panel includes an expansion notch extending to allow expansion pocket space on either side of said second panel.

* * * * *